United States Patent [19]

Hettinger, Jr.

[11] Patent Number: 4,915,820

[45] Date of Patent: Apr. 10, 1990

[54] REMOVAL OF COKE AND METALS FROM CARBO-METALLIC OILS

[75] Inventor: William P. Hettinger, Jr., Russell, Ky.

[73] Assignee: Ashland Oil, Inc., Ashland, Ky.

[21] Appl. No.: 699,757

[22] Filed: Feb. 8, 1985

[51] Int. Cl.[4] ..... C10G 17/00; C10G 29/04

[52] U.S. Cl. ..... 208/253; 208/127; 208/130; 208/251 R; 208/305; 502/38

[58] Field of Search ..... 208/253, 251 R

[56] References Cited

U.S. PATENT DOCUMENTS

| | | | |
|---|---|---|---|
| 2,981,674 | 4/1961 | Good | 208/70 |
| 4,243,514 | 1/1981 | Bartholic | 208/251 R |
| 4,263,128 | 4/1981 | Bartholic | 208/251 R |
| 4,328,091 | 5/1982 | Bartholic | 208/251 R |
| 4,374,021 | 2/1983 | Bartholic | 208/251 R |
| 4,384,949 | 5/1983 | Reagan et al. | 208/251 R |
| 4,417,975 | 11/1983 | Myers | 208/120 |
| 4,419,223 | 12/1983 | Myers et al. | 208/251 R |
| 4,432,863 | 2/1984 | Myers et al. | 208/121 |
| 4,446,009 | 5/1984 | Bartholic | 208/127 |
| 4,469,588 | 9/1984 | Hettinger | 208/251 R |

*Primary Examiner*—Helane Myers

*Attorney, Agent, or Firm*—Richard C. Willson, Jr.; James L. Wilson

[57] ABSTRACT

Coke and metals are removed from a carbo-metallic oil by contacting the carbo-metallic oil in a riser reaction zone with a relatively inert particulate sorbent material in the presence of steam and the resulting coked particulate sorbent material is regenerated in a regeneration zone in the presence of steam and oxygen to remove the carbonaceous deposits by means of oxidation, water gas reaction and carbon gasification. The operating conditions in the riser reaction zone and the regeneration zone are regulated to provide a maximum coke level on the regenerated particulate sorbent of about 0.25 wt. %.

1 Claim, 2 Drawing Sheets

REMOVAL OF COKE AND METALS FROM CARBO-METALLIC OILS

BACKGROUND OF THE INVENTION

1. Field of the Invention

The invention relates to producing a hydrocarbon feedstock having lower concentrations of carbon formers and metals, which feedstock can be used for heavy hydrocarbon conversion processes, such as the RCC SM process, and/or for the conventional fluid catalytic cracking (FCC) processes. More particularly, the invention is directed to the use of a relatively inert sorbent material composition as a means for removing the carbon formers and metals from the particular hydrocarbon stream in the presence of steam and the subsequent regeneration of the aforesaid sorbent material composition by treating the spent sorbent composition in an environment containing both steam and oxygen-containing gas under selected conditions.

2. Description of the Prior Art

In the 1960's, molecular sieves or zeolites were incorporated into the FCC catalysts. These zeolitic-containing catalysts revolutionized the FCC process. Such catalysts were considerably more active for cracking hydrocarbons than were the earlier amorphous or amorphous/kaolin-containing silica-alumina catalysts. These active catalysts caused various innovations to be developed to handle their high activities. Such innovations included riser cracking, shortened contact times, new regeneration processes, and improved catalysts containing molecular sieves or zeolites.

Subsequently, the petroleum industry began to suffer from a lack of crude availability as to quantity and quality accompanied by increasing demand for gasolines having increased octane values. The supply situation changed from a surplus of light, sweet crudes to a tighter supply having an increasing amount of heavier crudes containing higher amounts of sulfur and nitrogen. Often such heavier crudes also contained much higher concentrations of metals and carbon formers, along with increased amounts of asphaltic components.

Such metal contaminants and carbon formers have a rather severe deleterious effect upon such FCC molecular sieve-containing catalysts. They lower the activity and selectivity of the catalyst for producing liquid fuel products. Furthermore, they result in a reduced catalyst life.

Heavier crude oils contain more asphaltenes and polycyclic compounds that yield less or a lower volume of a high quality FCC gas oil charge stock. Such gas oil charge stock normally boils below a temperature of about 552° C. (1,025° F.), and is generally processed to contain a total metals level that is less than 1 ppm, preferably below 0.1 ppm, and Conradson carbon values that are substantially below 1 wt. %.

The need to process heavier and less desirable crudes caused the petroleum industry to search for and provide processing schemes which could utilize such heavier crudes in producing gasoline and other liquid fuel products. The literature has described many of these processing schemes, such as Gulf Oil Corporation's Gulfining and Union Oil's Unifining processes for treating residua, UOP's Aurabon process, Hydrocarbon Research's H-Oil process, Exxon's Flexicoking process to produce thermal gasoline and coke, H-Oil's Dynacracking and Phillip's Heavy Oil Cracking processes. Such processes employ thermal cracking or hydrotreating followed by FCC or hydrocracking operations to handle the higher content of metal contaminants (Ni-V-Fe-Cu-Na) and the high Conradson carbon values of 5 wt. % to 15 wt. %. Of course, such types of processing are accompanied by various drawbacks. Coking yields thermally-cracked gasoline which has a much lower octane value than gasoline that is obtained from a catalytic cracker, is unstable due to the production of gum from diolefins, and requires further hydrotreating and reforming to produce a higher octane product. Gas oil quality is degraded due to thermal reactions which produce a product containing refractory polynuclear aromatics and high Conradson carbon levels which are quite unsuitable for catalytic cracking. Hydrotreating requires expensive high-pressure hydrogen, multi-reactor systems made of special alloys, costly operations, and quite often a separate costly facility for the production of hydrogen.

Conventional FCC practice in the past has involved the treatment of those fractions of crude oils that are relatively free of coke precursors or heavy metals, or both, and boil within the range of about 343° C. (650° F.) to about 538° C. (1,000° F.). These fractions are referred to as "vacuum gas oil" (VGO) and are conveniently prepared from a crude oil by distillation at atmospheric pressure to remove the fractions boiling below about 343° C. (650° F.) and then separating by vacuum distillation a cut boiling between about 343° C. (650° F.) and about 552° C. (1,025° F.) from the heavier material.

This heavier material has been used for the production of asphalt, residual fuel oil, No. 6 fuel oil, and marine Bunker C fuel oil. Of course, there is considerable economical potential if the contaminants can be removed from such heavier material in order that it can be cracked along with the lighter oils.

There has been developed a method for cracking high boiling fractions, named with the RCC SM Process and disclosed by Myers, e.g., in U.S. Pat. Nos. 4,332,673; 4,299,687 and 4,341,624, each incorporated herein by reference. Hydrocarbons fractions suitable for cracking by the RCC Process are carbo-metallic oils at least about 70 percent of which boils above a temperature of 343° C. (650° F.) and which contain a carbon residue on pyrolysis of at least about 1 wt. % and at least about 4 ppm of nickel equivalents of heavy metals. The nickel equivalents of an oil can be calculated conveniently by using the following formula which is patterned after that of W. L. Nelson in Oil and Gas Journal, page 143, October 23, 1961:

$$\text{Nickel Equivalents} = Ni + V/4.8 + Fe/7.1 + Cu/1.23,$$

wherein the content of each metal that is present is expressed as the metal in parts per million by weight of that metal, based on the weight of feed. As used herein, the term "heavy metals" refers to nickel, vanadium, copper, and iron. Trace amounts of other heavy metal elements can be present. Crude oils, topped crudes, reduced crudes, residua, and extracts from solvent deasphalting are suitable feedstocks for the RCC Process, which can handle satisfactorily reduced crudes containing a heavy metals content within the range of about 10 ppm to about 100 ppm and a Conradson carbon content within the range of about 2 wt. % to about 8 wt. %.

While the RCC Process can treat effectively many crudes, certain crudes contain abnormally high contents of heavy metals and carbon precursors. Such poor-grade crudes are Mexican Mayan crudes or Venezuelan crudes. For example, a Mayan reduced crude can contain up to 500 ppm heavy metals, or more, and have a Conradson carbon value of 8 wt. %, or higher. Of course, the processing of these poor-grade crudes can lead to an uneconomical operation, as a result of the high coke-burning load on the regenerator and the high catalyst-addition rate that would be needed to maintain the activity and selectivity of the catalyst being employed in the process. In view of this, it is desirable to develop some means that would be more economical for processing poor-grade crude oils and residual stocks.

Both the contaminant metals (Ni-V-Fe-Cu-Na) and Conradson carbon affect a cracking catalyst that contains a zeolite and the operating parameters of a catalytic cracking operation. The metal content and Conradson carbon are two very effective restraints on the operation of a FCC unit and may even impose undesirable restraints on a Reduced Crude Conversion (RCC) unit from the standpoint of obtaining satisfactory conversion, selectivity, and catalyst life. Relative low levels of such contaminants are very detrimental to FCC units that employ catalysts containing zeolites. Moreover, as metals and Conradson carbon levels are increased, the operating capacity and the efficiency of a reduced crude cracking process are adversely affected or even made uneconomical.

As the zeolite-containing cracking catalyst is employed in either a FCC process or a RCC process, carbon or coke is deposited upon the catalyst particles and such carbonaceous deposits must be substantially removed from the catalyst particles periodically to maintain the activity or reactivate the particular catalytic material. The catalyst containing the hydrocarbonaceous deposits resulting in hydrocarbon conversion is restored to an equilibrium activity by burning off the deactivating hydrocarbonaceous material and residual coke in a regeneration zone in the presence of oxygen. Such burning off of the hydrocarbonaceous material heats the catalyst to an elevated temperature. The regenerated catalyst at that elevated temperature is recycled back to the reaction zone in the particular unit that employs the catalyst. The heat that is generated during the burning of the hydrocarbonaceous material in the regeneration zone is removed, at least partially, by the heated catalyst and is carried to the reaction zone, where it can be used to help vaporize the hydrocarbon feed and to furnish heat for the endothermic cracking reaction. In addition, hot regeneration flue gases remove a portion of the regeneration heat. Generally, the temperature is maintained in the regenerator below 871° C. (1,600° F.), since higher temperature would be deleterious to the metallurgy of the processing vessel and to the hydrothermal stability of the catalytic material being employed.

The temperature and steam partial pressure at which the zeolite begins to rapidly lose its crystalline structure determine the hydrothermal stability of such zeolite-containing catalyst. A lower-activity material results. The presence of steam is highly critical. The steam is generated by the burning of adsorbed and adsorbed (sorbed) carbonaceous material which has a significant hydrogen content. The hydrogen-to-carbon atomic ratios are generally greater than about 0.5. The high-boiling sorbed hydrocarbons provide the hydrocarbonaceous-material deposit. The deposit is obtained particularly from asphaltic or polycyclic high molecular weight materials which do not vaporize at temperatures below 552° C. (1,025° F.). Such materials have a modest hydrogen content and include high-boiling nitrogen-containing hydrocarbons, as well as related high molecular weight porphyrins and asphaltenes. The high molecular weight nitrogen compounds usually do not boil or vaporize below about 552° C. (1,025° F.) and can be either basic or acidic in nature. The basic nitrogen compounds tend to neutralize the acid cracking sites, while those nitrogen compounds that are more acidic can be attracted to metal sites on the catalyst. The porphyrins and asphaltenes, which do not vaporize at temperatures as high as 552° C. (1,025° F.), may contain elements other than carbon and hydrogen. As used in this specification, the term "heavy hydrocarbons" includes all carbon- and hydrogen-containing resid compounds that do not boil or vaporize at a temperature in the range of 343° C. (650° F.) up to about 552° C. (1,025° F.), regardless of whether other elements are also present in the compound.

The heavy metals in the feedstock are generally present as porphyrins and/or asphaltenes. However, certain of these metals, particularly iron and copper, may be present as a free metal or as inorganic compounds resulting from either corrosion of process equipment or contaminants from other refining processes.

Coke production increases as the Conradson carbon value of the feedstock increases. This increased load will raise the regeneration temperature. Consequently, any given cracking-regeneration unit may be limited as to amount of feed that can be processed, because of the Conradson carbon content of the feed.

The metal-containing fractions of reduced crudes contain Ni-V-Fe-Cu in the form of porphyrins and asphaltenes. The metal-containing hydrocarbons are deposited on the catalyst during processing and are cracked in the reaction zone of the processing unit to deposit the metal with hydrocarbonaceous material on the catalyst. Such deposits are carried by the catalyst substantially as metallo-porphyrin or asphaltene to a regeneration operation and converted to the metal oxide during regeneration. As taught in the literature, the deposited metals result in non-selective or degradative cracking and dehydrogenation to produce increased amounts of deposited carbonaceous material and light gaseous products, such as hydrogen, methane, and ethane. The cracking selectivity is thus adversely affected, resulting in poor product yields and poor quality gasoline and light cycle oil. Of course, increased production of light gases puts an increased demand on the downstream gas plant gas compressor capacity. The increased coke production has a negative impact on yield, adversely affects catalyst activity-selectivity, greatly increases regenerator air demand and compressor capacity, and contributes to high regenerator temperature.

Certain crudes, such as Mexican Mayan or Venezuelan crudes, contain abnormally high metal and Conradson carbon contents and will, as a result, lead to an uneconomical operation. The high coke burning load on the regenerator and the high catalyst addition rate needed to maintain catalyst activity and selectivity prompt the uneconomical operation. In view of this, it is desirable to develop an economical means of processing poor grade crude oils, such as the Mexican Mayan or Venezuelan crudes, since such crudes are more readily available and cheaper than crudes obtained from the Middle East.

The art suggests various processes for the reduction of metals and Conradson carbon values of residual oil, topped or reduced crudes, and other contaminated high boiling oil fractions. The disclosure of each of the prior art patents and patent applications discussed hereinbelow is incorporated herein and made a part hereof by reference thereto.

For example, in U.S. Pat. No. 4,243,514, Bartholic disclosed a process which involves contacting a reduced crude fraction or other contaminated oil fraction with a sorbent material at elevated temperatures in a sorbing zone, such as in a fluid bed contact zone, to produce a product of reduced metal and Conradson carbon value. One of the sorbents is an inert solid initially composed of kaolin, which has been spray dried to yield microspherical particles having a surface area below 100 $m.^2/gm.$ and a catalytic cracking microactivity (MAT) value of less than 20 and which is calcined at high temperature, so as to achieve better attrition resistance.

U.S. Pat. No. 4,412,924, to Hettinger, Jr., et al, discloses a process for the decarbonization-demetallization of a poor quality residual oil feed boiling above about 343° C. (650° F.) and comprising a substantial amount of Conradson carbon components to provide a higher grade of oil feed by contacting the poor quality oil feed with sorbant particle material containing one or more metal additives selected to catalyze the endothermic removal of coke with $CO_2$. Selected sorbent decarbonization conditions resulted in the depositing of substantial quantities of carbonaceous material and metals on the sorbent in the decarbonizing zone. The sorbent material containing the metals and hydrocarbonaceous deposits is then regenerated in the presence of gas streams containing oxygen and carbon dioxide in separate sorbent regeneration zones at a temperature that is sufficiently elevated to remove the residual coke to a desired low level. The regenerated sorbent particle material at an elevated temperature below about 816° C. (1,500° F.) is recycled to the decarbonizing zone for contact with additional feed.

U.S. Pat. No. 4,417,975 to Myers et al discloses a carbo-metallic oil conversation process wherein the temperature within a catalyst regenerator is controlled by introducing liguid water into a catalyst bed in the regenerator.

U.S. Pat. No. 4,432,863 to Myers et al discloses a process of economically converting carbo-metallic oils to liquid fuel products wherein a suspension of particulate cracking catalysts and carbo-metallic oil is passed through a riser reaction zone, the coke-laden catalyst is separated from the resulting stream of hydrocarbons, the coke-laden catalyst is stripped and regenerated, and the regenerated catalyst is contacted with a reducing gas under reducing conditions sufficient to reduce at least a portion of the oxidized metal deposits to a reduced state. Then the reduced catalyst is sent to the conversion zone for contact with fresh carbo-metallic oil. Water is introduced into the riser reactor conversion zone in an amount, which when coupled with a selected amount of reduced nickel on the recycled catalyst, is sufficient to provide steam reforming, which results in hydrogen-deficient components of the feed being converted to products having higher ratios of hydrogen to carbon and a reduced amount of feed being converted to coke.

U.S. Pat. No. 4,417,975, to Myers et al discloses that water can be added to the oxygen-containing gas introduced into the regenerator to control the heat load in the regenerator of a fluid catalyst system.

The present invention is directed to the use of an inert sorbent to remove carbon formers or carbon precursors (heptane-insoluble material) and metals that are present in a carbo-metallic oil at elevated temperatures and in the presence of steam in a riser reaction zone, promoting the reaction of carbon and the formation of hydrogen, the separation of the resulting gaseous products from the spent coked sorbent, the stripping and regeneration of the spent coked sorbent in the presence of an oxygen-steam environment at elevated temperatures to remove the carbonaceous deposits by means of oxidation, water gas reaction, carbon gasification, and possibly some steam reforming and the recycling of the regenerated sorbent to the riser reaction zone.

The invention provides a means for handling those reduced crudes that are not amenable to reduced crude treating operations as a result of high-metals content and high Conradson carbon content. The process of this invention will remove a major portion of the metals and heptane-insoluble material and, depending upon the severity, will yield a product that is amenable to processing in a RCC or FCC unit.

BRIEF DESCRIPTION OF THE DRAWINGS

The accompanying

Figure 1:
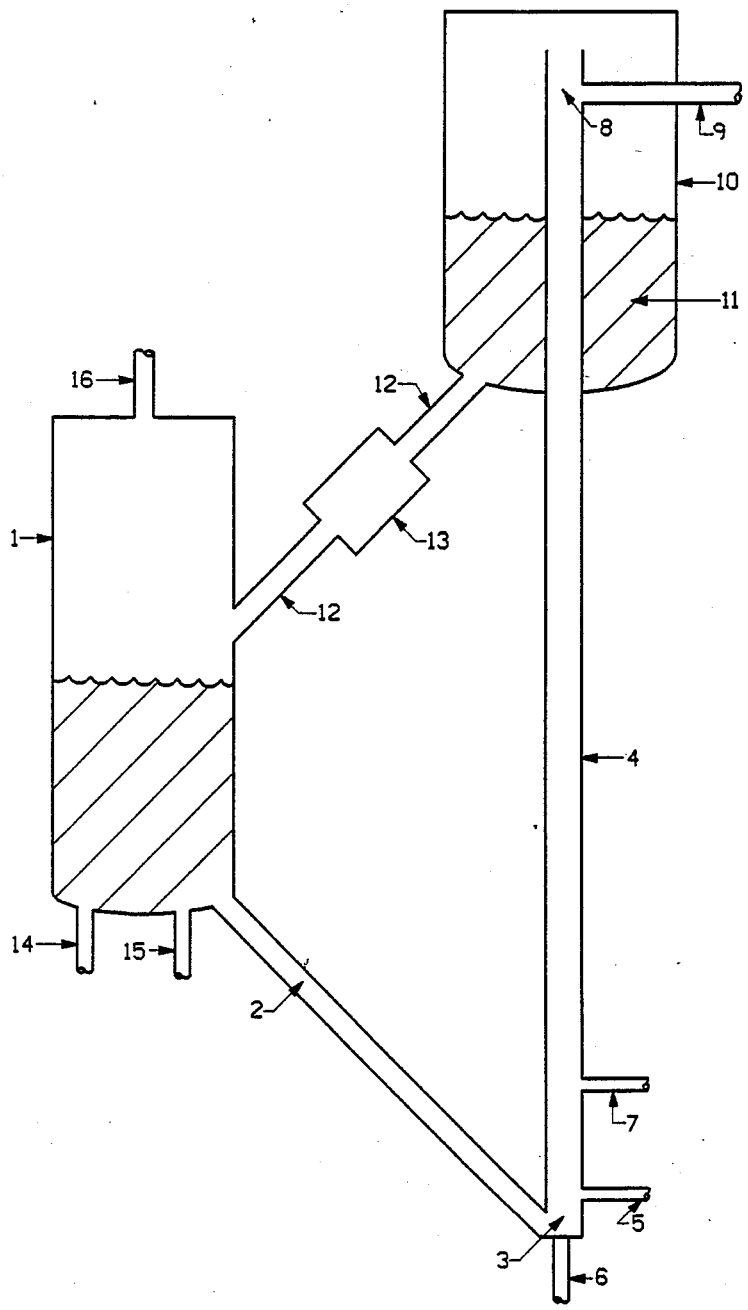
FIG. 1 is a schematic diagram of an apparatus for carrying out the process of the present invention.

These figures show only the major pieces of equipment. Auxiliary equipment, such as valves, pumps, compressors, heat exchangers, and the like, are not shown, but would be recognized easily by those skilled in the art to be used at selected points. The embodiment depicted by these figures is for the purpose of illustration only and is not intended to limit the scope of the present invention.

DESCRIPTION OF THE INVENTION

According to the present invention, there is provided a method for treating poor-grade reduced crudes and residual feedstocks to obtain a hydrocarbon stream that is suitable as a feedstock for a FCC process, or the RCC process, or both. As used herein, the term "poor-grade" refers to a hydrocarbon stream or mixture that contains at least 100 ppm nickel equivalents of heavy metals, or a Conradson carbon value of at least 6, or both. A hydrocarbon stream having such a metal content and/or Conradson carbon value can also be identified as a carbo-metallic oil and is referred to as such herein.

The method or process of the present invention employs a relatively inert sorbent material, which is cycled between a riser reaction zone, a stripping zone, and a burning zone or a regeneration zone. The sorbent material removes heavy metals and coke-formers or coke precursors from the hydrocarbon stream in the riser reaction zone and the amounts of such contaminants deposited upon the sorbent material are subsequently reduced when the spent sorbent material is passed through the burning zone or regeneration zone. In this improved process, steam is introduced into both the riser reaction zone and the burning zone or regeneration zone and the operating conditions of these zones are regulated and maintained to provide more severe conditions in either zone than those found in conventional fluidized catalytic operations and to maintain a sufficiently low carbon level on the regenerated sorbent material without excessive sorbent deactivation and severe unit metallurgy problems occurring.

The higher that a Conradson carbon value of a residual oil or reduced crude is, the greater is the coke load that is charged to the regeneration zone of the process of the present invention. The presence of increased amounts of hydrocarbonaceous deposits on the sorbent material passing through the regenerator will lead to increased temperatures in the regenerator that are above 760° C. (1,400° F.), and possibly above 871° C. (1,600° F.). In fact, the amount of heptane insolubles that are deposited on the sorbent can lead to temperatures that exceed 927° C. (1,700° F.). The carbonaceous material that is deposited on the sorbent material is made up of about 5 wt. % hydrogen and about 95 wt. % carbon. The regeneration section of the process of the present invention is utilized as a gasifier to achieve the temperatures needed, but not to exceed 982° C. (1,800° F.). A mixture of oxygen and steam is employed to regenerate the spent sorbent material. The carbonaceous material is removed at the elevated temperatures by means of oxidation, water gas, and carbon gasification reactions.

It is contemplated that the sorbent materials that can be utilized in the process of this invention include solids of low catalytic activity. Examples of such sorbent materials are spent catalysts having low activities, clays, such as bentonite, kaolin, attapulgus, montmorillonite, smectites, and other two-layered lamellar silicates, mullite, pumice, silica, laterite, low-surface area silica gel, low-surface are bauxite and various combinations thereof. Such materials have been calcined at an elevated temperature, e.g., 538° C. (1,000° F.) to 871° C. (1,600° F.), to provide new sorbent materials having a low surface area, preferably below 50 $m.^2/gm.$, but sufficient pore volume to absorb the metals and Conradson carbon, such as about 0.50 c.c./gm. to about 0.30 c.c./gm., and enough cracking activity to convert the porphyrins and to partially crack or condense the Conradson carbon-heptane insolubles, such as a microactivity value of below 20, as measured by the ASTM Test Method No. D3907-80. The sorbent material should have a particle size within the range of about 20 microns to about 150 microns.

An embodiment of such a sorbent material is a spray dried solid particle composition in the form of microspherical particles generally in the size range of about 20 microns to about 200 microns, more particularly in the range of about 30 microns to about 150 microns, and preferably in the range of about 40 microns to about 100 microns. Such particle sizes will ensure adequate solids fluidization properties.

While the processing of hydrocarbon feedstocks for FCC operations falls within the scope of the present invention, the invention is especially directed to the preparation and processing of heavy feeds comprising residual oils, reduced crudes, and other high-boiling oil feeds containing carbo-metallic components, which feeds have high metals contents, provide high Conradson carbon values, and do not vaporize up to a temperature of about 552° C. (1,025° F.). Such feeds would have a Conradson carbon value within the range of about 6 wt. % to about 20 wt. % and a nickel equivalents value within the range of about 100 to about 500 ppm.

According to the present invention, a high-boiling hydrocarbon feedstock selected from the group consisting of residual oils, reduced crudes, topped crudes, and other high-boiling feeds containing substantial amounts of carbon formers, and combinations thereof is contacted in a riser reaction zone with a fluidizable sorbent particulate material in the presence of steam at temperatures within the range of about 482° C. (900° F.) to about 704° C. (1,300° F.). As referred to herein, a "substantial amount" of carbon formers would be that amount that would provide a Conradson carbon valve of at least 6 wt. % and a "substantial amount" of metals would be that amount that would correspond to a nickel equivalents value of at least 100 ppm. The residence time or the contact time of the high-boiling hydrocarbon feed in the riser reaction zone is maintained at a value within the range of about 0.5 sec. to about 2 sec. The steam is added to react with the retained carbonaceous deposits on the sorbent material to produce synthesis gas, i.e., a mixture of carbon monoxide and hydrogen. This reaction is quite rapid at elevated temperatures within the range of about 593° C. (1,100° F.) to about 649° C. (1,200° F.). A pressure within the range of about 1 atm. (0 psig) to about 4.4 atm. (50 psig) is maintained in the riser reaction zone. The weight ratio of steam to hydrocarbon feed is held within the range of about 2.0 gm. of water per 100 gm. of hydrocarbons to about 25 gm. of water per 100 gm. of hydrocarbons, while the weight ratio of sorbent material to hydrocarbon feed is maintained at a level within the range of about 2 gm. of sorbent per gm. of hydrocarbons to about 10 gm. of sorbent per gm. of hydrocarbons.

Steam is introduced into the riser reaction zone of the process of the present invention to act not only as a diluent, but also to provide steam reforming reactions in the reaction zone. The nickel deposited upon the particulate sorbent will catalyze the steam reforming reaction, particularly if the nickel is in the reduced state. Consequently, it is contemplated that the regenerated particulate sorbent can be treated with a reducing gas. Such treatement of the regenerated particulate sorbent with a reducing gas can be conducted in the regenerated sorbent standpipe, or in a separate vessel or system between the regenerated sorbent outlet of the regenerator and the riser wye, and/or in the riser itself. Of course, care must be used to prevent the backflow of explosive reducing gas to the regeneration zone. It is preferred to use carbon monoxide as the reducing gas where there is a possibility of at least some backflow into the regeneration zone. This could occur when the lower portion of the regenerated sorbent standpipe is employed as a reducing zone. The carbon dioxide formed and the excess carbon monoxide reducing gas can then pass back conveniently into the regeneration zone and be discharged from the system with the flue gas from the regeneration zone. An excellent and preferred source of carbon monoxide is the flue gas from the first stage of two-stage regeneration zone which is operated with an oxygen-deficient first stage and a relatively high $CO/CO_2$ ratio, as explained by Myers, et al, in U.S. 4,432,863. In those cases where the bottom of the riser or a separate reducing vessel is employed as the reducing zone, hydrogen is the preferred reducing gas.

It is believed that steam reforming occurs in the riser reaction zone where the particulate sorbent containing reduced nickel is contacted with the hydrocarbon stream in the presence of water, the ratio of water to hydrocarbon being relatively high. Carbon monoxide and hydrogen are formed. The resulting carbon monoxide may also react with water to form carbon dioxide and additional hydrogen. The presence of labile hydrogen in the riser reaction zone tends to minimize or to reduce the conversion of hydrogen-deficient carbometallic oils to coke. The use of steam reforming in a FCC conversion zone through the addition of steam to the zone which contains both a hydrogen-deficient hydrocarbon stream and a cracking catalyst containing reduced nickel in adequately disclosed by Myers, et al, in U.S. 4,432,863.

The heavy hydrocarbon feedstock that is to be decarbonized and demetallized is introduced into the lower portion of a riser reaction zone to be placed in contact with sorbent particulate material which is at a temperature in the range of about 704° C. (1,300° F.) to about 1010° C. (1850° F.) and preferably about 760° C. (1,400° F.) to about 982° C. (1,800° F.) to form a suspension in said riser reaction zone and to provide a temperature in the riser reaction zone within the range of about 482° C. (900° F.) to about 704° C. (1,300° F.). It is to be noted that the vaporization-atomization of the high-boiling hydrocarbon feedstock can be aided by charging such feedstock to the riser in combination with one or more diluent components, such as water, steam, naphtha, noncombustion-supporting flue gas, or other suitable vapors or gases, such as wet gas, dry gas and such gases also containing $H_2$. Such diluent components can also act as a lift gasiform medium to control residence time of the vaporized hydrocarbon material within a desired range. Alternatively, a suspension of sorbent particulate material in lift gas may be initially formed in a bottom portion of the riser before adding the high-boiling hydrocarbons feedstock with suitable atomizing diluent.

More particular operating conditions that are employed in the riser reaction zone comprise a temperature within the range of about 482° C. (900° F.) to about 649° C. (1,200° F.), a residence time of the high-boiling hydrocarbon feed in contact with the solid sorbent within the range of about 1 sec. to about 2 sec., a pressure within the range of about 1 atm. (0 psig) to about 3.38 atm. (35 psig), a ratio of steam to hydrocarbon feed within the range of about 4 gm. of water per 100 gm. of hydrocarbons to about 20 gm. of water per 100 gm. of hydrocarbons, a weight ratio of sorbent material to hydrocarbon feed within the range of about 3 gm. of sorbent per gm. of hydrocarbons to about 8 gm. of sorbent per gm. of hydrocarbons. Preferred operating conditions that are used in the riser reaction zone of the process of the present invention comprise a temperature within the range of about 482° C. (900° F.) to about 621° C. (1,150° F.), a residence time within the range of about 1 sec. to about 2 sec., a pressure within the range of about 1.34 atm. (5 psig) to about 2.36 atm. (20 psig), a weight ratio of steam to hydrocarbons within the range of about 5 gm. of water per 100 gm. of hydrocarbons to about 15 gm. of water per 100 gm. of hydrocarbons, and a weight ratio of sorbent to hydrocarbons within the range of about 4 gm. of sorbent per gm. of hydrocarbons to about 7 gm. of sorbent per gm. of hydrocarbons.

The sorbent material containing the carbonaceous deposits, i.e., the spent sorbent material will have a coke level within the range of about 0.8 wt. % to about 8.0 wt. %, based upon the weight of the sorbent material, as it exits from the riser reaction zone.

The sorebent material, whether regenerated or spent, will present a nickel and vanadium metals content within the range of about 5,000 ppm (by wt.) to about 70,000 ppm (by wt.), an advantageous range of about 7,000 ppm (by wt.) to about 50,000 ppm (by wt.), and an ideal range of about 10,000 ppm (by wt.) to about 30,000 ppm (by wt.).

As the effluent from the riser reaction zone exits therefrom, the sorbent material containing the carbonaceous deposits is separated rapidly from that various vapors by means of any of the techniques that are well known in the art or by employing the vented riser concept that is described by Myers, et al, in U.S. Pat. No. 4,066,533 and 4,070,159. After separation of the coked sorbent material from the vaporous products at the outlet of the riser, the sorbent material containing the hydrocarbonaceous deposits is collected as a relatively dense fluidized bed of sorbent material in the lower portion of a disengagement vessel, which may surround the upper end of the riser reaction zone. The collected sorbent material is then transferred to a stripper zone where any loosely-held vaporized hydrocarbons are removed therefrom before the sorbent material is passed to a regeneration zone. Subsequently, the sorbent particulate material, containing the metal and carbonaceous deposits, is contacted in the regeneration zone with a gas containing oxygen, carbon dioxide, and steam to remove the coke via oxidation, water gas, and carbon gasification reactions.

The operating conditions that are maintained in the stripping zone include a pressure within the range of about 1 atm. (0 psig) to about 4.4 atm. (50 psig), a temperature within the range of about 482° C. (900° F.) to about 704° C. (1300° F.), and a weight ratio of steam to sorbent material within the range of about 1 lb. steam/1,000 lb. catalyst to about 20 lb. steam/1,000 lb. catalyst. Preferably, the operating conditions in the stripping zone include a pressure within the range of about 1 atm. (0 psig) to about 3.0 atm. (30 psig), a temperature within the range of about 496° C. (925° F.) to about 566° C. (1050° F.), and a weight ratio of steam to sorbent material within the range of about 1 lb/1,000 lb. catalyst to about 10 lb./1,000 lb. catalyst.

Various reactions occur in a regeneration zone during the combustion of hydrocarbonaceous deposits on spent sorbent material. Such hydrocarbonaceous deposits are made up of approximately 5 wt. % hydrogen and approximately 95 wt. % carbon. Primarily, in the carbon is converted to carbon oxides and the hydrogen is converted to water. These reactions are exothermic. Other reactions that can occur are (1) the reaction of $CO_2$ with hydrogen to produce CO and water, which is only slightly exothermic, (2) the reaction of $CO_2$ with carbon to produce CO, (3) the reaction of water with carbon to form CO and hydrogen, and (4) the reaction of CO with water to produce $CO_2$ and hydrogen. The above reactions (2), (3), and (4) are endothermic in nature. As reported by Hettinger, Jr., et al, in U.S. Pat. No. 4,412,914, selected metal additives, such as Li, Na, K, Sr, V, Ta, Mo, Re, Fe, Co, Ni, Ru, Rh, Pd, Os, Ir, Pt, Cu, Ag, Au, Sn, and Bi, in the elemental form, as oxides, as salts, or as organo-metallic compounds, can be used to catalyze the endothermic removal of hydrocarbonaceous material from a solid sorbent material. Hence, it is contemplated that such metal additives could be employed in the process of the present invention to help control the temperatures in the regeneration zone by promoting the endothermic and slightly-exothermic reactions. Moreover, the steam is introduced along with oxygen into the regeneration zone to aid in the promotion of the above reactions (3 ) and (4).

The operating conditions that are employed in the regeneration zone comprise a temperature within the range of about 704° C. (1300 F.) to about 982° C. (1,800° F.), a pressure within the range of about 1 atm. (0 psig) to about 4.4 atm. (50 psig), a weight ratio of steam to oxygen within the range of about 0.1 to about 10, and a weight ratio of oxygen to coke within the range of about 1 to 3. More particularly, the operating conditions comprise a temperature within the range of about 732° C. (1,350° F.) to about 927° C. (1,700° F.), a pressure within the range of about 1 atm. (0 psig) to about 3.38 atm. (35 psig), a weight ratio of steam to oxygen within the range of about 0.2 to about 8, and a weight ratio of oxygen to coke within the range of about 1.1 to about 2.8. The preferred operating conditions comprise a temperature within the range of about 788° C. (1,450° F.) to about 899° C. (1,650° F.), a pressure within the range of about 1.34 atm. (5 psig) to about 2.36 atm. (20 psig), a weight ratio of steam to oxygen within the range of about 0.2 to about 6, and a weight ratio of oxygen to coke within the range of about 1.3 to about 2,5.

The hydrocarbonaceous material deposited upon the sorbent material is removed therefrom by the combination of reactions mentioned hereinabove, which reactions comprise combustion to form carbon oxides and reaction of carbon dioxide with carbon and hydrogen to form carbon monoxide and water. A regenerated sorbent material is obtained, which regenerated sorbent material has a coke level within the range of about 0.05 wt. % to about 0.50 wt. %, based upon the weight of the regenerated sorbent material. Typically, it contains less than about 0.25 wt. % residual carbon, more particularly, less than about 0.1 wt. % coke. The residence time of the sorbent material in the regeneration zone is within the range of about 300 sec. to about 3,000 sec. The regenerated sorbent material is then recycled to the riser reaction zone, where the sorbent material at a high temperature is brought into contact with additional hydrocarbon feed containing the high metal and Conradson carbon contents to repeat the above described cycle.

Under the conditions desired in the regeneration zone, the regeneration zone is utilized as a gasifier. The sorbent material is regenerated with a mixture of oxygen and steam to take advantage of the elevated temperatures that are employed in the regeneration zone. As pointed out hereinabove, the coke is removed by means of oxidation, water gas, and carbon gasification reactions. It is to be noted that the excessive temperatures, i.e., excessive when compared to those that are employed in FCC operation, do not harm the sorbent material, since the sorbent material has been calcined at temperatures near these higher limits.

In the above-described operation, the combination of the higher temperatures in the riser reaction zone and the regeneration zone along with the specified treating environments provide a means or a method for decarbonizing and demetallizing poor-grade carbo-metallic feedstocks to furnish a hydrocarbon stream containing amounts of heavy metals and Conradson carbon that are acceptable for use in the RCC Process, or possibly for use in a FCC process.

It is the combination of using steam reforming in the riser reaction zone to control conversion of hydrogen-deficient carbo-metallic hydrocarbons to coke with the application of oxidation, water gas, and gasification reactions in the regeneration zone to control the temperature in the regeneration zone, when employing a sorbent as the solid particulate material in the fluid system, so as to regulate the conditions that are employed in the riser reaction zone and the conditions that are used in the regeneration zone and balance each with the other, that provides the improvement of the process of the present invention. The combination of the various reactions in the two zones enables one to control not only the production of coke in the riser reaction zone, but also the temperature in the regeneration zone while removing greater amounts of coke from the particulate sorbent.

According to the present invention, there is provided an improved process for the decarbonization and demetallization of a heavy hydrocarbon stream containing substantial amounts of carbon formers and metals, which process comprises contacting said stream in a riser reaction zone with a relatively inert solid particulate sorbent in the presence of steam and under reaction conditions to form a coked particulate sorbent and gaseous hydrocarbons, separating said gaseous hydrocarbons from said coked particulate sorbent, passing said coked particulate sorbent through a stripping zone to remove from said coked particulate sorbent loosely-held hydrocarbons and to provide a stripped, coked particular sorbent, contacting said stripped, coked particulate sorbent in a regeneration zone with a mixture of steam and oxygen under suitable regeneration conditions to provide a regenerated particulate sorbent having reduced amounts of carbon and metals, and passing said regenerated particulate sorbent to said riser reaction zone, the conditions that are employed in said riser reaction zone and the conditions that are employed in siad regeneration zone being regulated and balanced with each other to provide a maximum temperature in said riser reaction zone of 704° C. (1,300° F.), a maximum temperature in said regeneration zone of 982° C. (1,800° F.), and a maximum carbon level on said regenerated particulate sorbent of about 0.50 wt. %, based upon the weight of said regenerated particulate sorbent.

Accordingly, there is provided in a process for the decarbonization and demetallization of a hydrocarbon stream containing substantial amounts of carbon formers and metals, wherein a relatively inert solid particulate sorbent is contacted in a vertical riser reaction zone with said stream at an elevated temperature to deposit metals and coke upon said particulate sorbent and to form a coked particulate sorbent and gaseous hydrocarbons, gaseous hydrocarbons are separated from said coked particulate sorbent at the top of said riser reaction zone, said coked particulate sorbent is stripped to form a stripped, coked particulate sorbent, said stripped, coked particulate sorbent is regenerated by contacting it with an oxygen-containing gas at an elevated temperature to provide a regenerated particulate sorbent having a reduced amount of coke, and said regenerated particulate sorbent is sent to said riser reaction zone, the improvement which comprises contacting said particulate sorbent in said riser reaction zone with said stream in the presence of steam under reaction conditions comprising a maximum temperature of about 704° C. (1,300° F.) to provide a coke level on said cooked particulate sorbent within the range of about 0.8 wt. % to about 8.0 wt. %, based upon the weight of said coked particulate sorbent, regenerating said stripped, coked particulate sorbent in the presence of steam and oxygen in said regeneration zone under regeneration conditions comprising a maximum temperature of about 982° C. (1,800° F.), and regulating the conditions in both the riser reaction zone and the regeneration zone in order to provide a maximum coke level on the regenerated particulate sorbent of about 0.50 wt. %, based upon the weight of said regenerated particulate sorbent.

It is to be understood that the process of the present invention is not intended to be limited by the reaction schemes presented hereinabove, nor is it to be limited by the following example, which is presented for the purpose of illustration only.

EXMAPLE

Referring to the accompanying FIG. 1, which represents a preferred embodiment of the process of the present invention, 4 lbs/hr of regenerated sorbent material is transferred from regeneration zone 1 via regenerated sorbent standpipe 2 to the lower inlet or wye 3 or riser reaction zone 4, where it contacts 1 lb/hr of a carbo-metallic oil that is being transferred to the lower inlet 3 of riser reaction zone 4 via feedline 5. The sorbent material is a calcined kaolin clay which exhibits the typical properties presented hereinbelow in Table I. Typical properties of carbo-metallic oils are presented hereinbelow in Table II.

TABLE I

Typical Physiochemical Properties of Sorbent Material

| Sorbent Type: | Fresh Sorbent | Equilibrium Sorbent |
|---|---|---|
| Surface Area, $m^2/g$ | 8.0 | 6.0 |
| Pore Volume, cc/g | | |
| Water P.V. | .21 | .19 |
| Total Mercury P.V. | 0.23 | — |
| (<6000Å) | (0.20) | — |
| Skeletal Density, g/cc | 2.67 | — |
| A.B.D., g/cc | 0.81 | .98 |
| Particle Size Dist., % | | |
| 0–149 microns | 99.0 | 99.0 |
| 0–105 microns | 93.0 | 96.0 |
| 0–80 microns | 72.0 | 62.0 |
| 0–40 microns | 18.0 | 1.0 |
| 0–20 microns | 1.0 | 0.0 |
| Avg. Particle Size, | 65.0 | 76.0 |
| Pore Size Distribution, cc/g (%) | | |
| >6000Å | .03(0) | |
| 6000–1000Å | .13(63) | |
| 1000–400Å | .05(24) | |
| 400–200Å | .01(5) | |
| 200–100Å | .01(3) | |
| 100–80Å | .00(1) | |
| 80–60Å | .00(1) | |
| <60Å | .01(3) | |
| Loss On Ignition | 0.6 | |
| Mat Conversion* | 7.0 | 8.0 |
| Chemical Analyses: (wt % I.B.) | | |
| $SiO_2$ | 52.0 | 52.0 |
| $Al_2O_3$ | 45.1 | 45.0 |
| $TiO_2$ | 1.93 | 1.9 |
| $Fe_2O_3$ | 0.32 | 0.59 |
| $Na_2O$ | 0.29 | 0.30 |
| Metakao./Mullite/Sp. | 7.0 | 23.0 |
| Bayerite/Amor. $Al_2O_3$ | — | |
| Boehmite/Pseudo. | — | |
| Silica | — | |
| Anatase | 2.0 | |
| Alpha Quartz | 0.0 | |

TABLE II

Typical Properties of Carbo-Metallic Oils

| Test Feed Number | 1 | 2 | 3 |
|---|---|---|---|
| API Gravity @ 60° F. | 13.50 | 15.90 | 16.90 |
| Initial Boiling Point F. | | | |
| 5% | 595.0 | 568.0 | 473.0 |
| 10% | 682.0 | 641.0 | 508.0 |
| 20% | 812.0 | 748.0 | 574.0 |

TABLE II-continued

Typical Properties of Carbo-Metallic Oils

| Test Feed Number | 1 | 2 | 3 |
|---|---|---|---|
| 30% | 902.0 | 840.0 | 645.0 |
| 40% | 951.0 | 919.0 | 729.0 |
| 50% | 1080.0 | 1020.0 | 867.0 |
| 60% | 1200.0 | 1125.0 | 951.0 |
| 70% | 1350.0 | 1260.0 | 1050.0 |
| 80% | 1500.0 | 1500.0 | 1200.0 |
| 90% | 1800.0 | 1800.0 | 1500.0 |
| 95% | 1800.0 | 1800.0 | 1500.0 |
| Crack Point | 953.0 | 967.0 | 972.0 |
| Recovery | 41.0 | 50.0 | 64.0 |
| Sulfur PPM | | | |
| Bromine Number | 6.60 | 6.10 | 9.50 |
| Basic Nitrogen Wt % | 0.1047 | 0.0826 | 0.0718 |
| Total Nitrogen Wt % | 0.10 | 0.11 | 0.13 |
| Chlorides PPM | | | 2.50 |
| Ramsbottom Carbon Wt % | 9.40 | 9.16 | 3.34 |
| Viscosity at 140° F., CS | 760.0 | 302.30 | 50.02 |
| Viscosity at 210° F., CS | 90.13 | 49.13 | 16.79 |
| Vol % @ 430° F. | | | |
| Volume % at 630° F. | | | 28.0 |
| Iron, ppm | 4.00 | 4.00 | 7.00 |
| Vanadium, ppm | 56.00 | 51.00 | 40.00 |
| Nickel, ppm | 27.00 | 19.00 | 12.00 |
| Sodium, ppm | 7.00 | 7.00 | 7.00 |
| Copper, ppm | 1.00 | 1.00 | 1.00 |
| Sulfur, wt % | 1.47 | 1.35 | 1.30 |

The temperature of the regenerated sorbent as it enters the riser reaction zone 4 is within the range of about 704° C. (1,300° F.) to about 982° C. (1,800° F.). Steam at a temperature within the range of about 232° C. (450° F.) to about 704° C. (1,300° F.) is introduced into riser reaction zone 4 by way of line 6 at the bottom of riser reaction zone 4 or by way of line 7 above the sorbent-feed contact point, or at both places. Steam is added to riser reaction zone 4 at a rate within the range of about 0.1 lb./lb. of feed to about 20 lb./lb. of feed or lb./sorbent.

The mixture of regenerated sorbent material, hydrocarbon feed, and steam is transferred up the riser reaction zone 4 with a contact time within the range of about 1 sec. to about 2 sec. The resulting coked sorbent material and gaseous products are separated via vented riser 8, the gaseous products being transferred to a product separator via transfer line 9 and the spent coked sorbent material dropping to the bottom of reactor disengaging vessel 10 to form a dense bed 11.

The gaseous products obtained from the riser reaction zone 4 are separated into a light gaseous hydrocarbon product stream comprising $C_2$-minus hydrocarbons, hydrogen, and carbon monoxide, a $C_3$-plus hydrocarbon product stream, and a water phase comprising absorbed sulfur compounds and nitrogen compounds.

Figure 2:
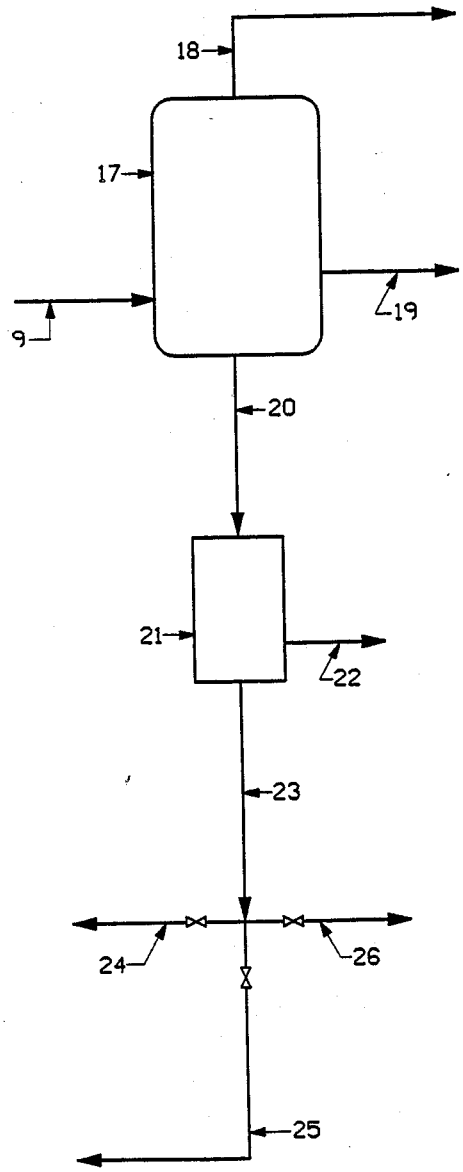
FIG. 2 is a simplified diagram of a typical product recovery system.

Any conventional product recovery system can be employed to separate the gaseous products into the various product streams. A typical product recovery system is depicted in FIG. 2. It is to be understood that this typical product recovery system is presented for the purpose of illustration only and is not intended to limit the scope of the present invention.

Referring to FIG. 2, the gaseous products from line 9, which extends from the apparatus shown in FIG. 1, are passed into separation zone 17. A light gaseous hydrocarbon product stream, which comprises $C_2$-minus hydrocarbons, hydrogen, and carbon monoxide, is withdrawn from separation zone 17 by way of line 18. The $C_3$-plus hydrocarbon product stream is withdrawn from separation zone 17 via line 19, while the water phase, a water-containing condensation product, is withdrawn via line 20. After sulfur oxides and nitrogen oxides are removed from the $C_2$-minus hydrocarbon product in equipment not shown, the cleaned $C_2$-minus hydrocarbon product stream in one embodiment is conducted into a methanation zone, wherein the $C_2$-minus gaseous material comprising hydrogen and carbon monoxide is synthesized to methane under exothermic reaction conditions. Alternatively, all or a portion of the $C_2$-minus product gas is admixed with water and sent to a water gas shift operation, from which is obtained a product gas rich in hydrogen and comprising $CO_2$ and some CO. In a preferred embodiment, the product from the water gas shift operation is sent to the methanation zone for conversion of that stream to methane. In still another embodiment, all or a portion of the $C_2$-minus product gas is sent directly to riser reaction zone 4. Neither the methanation zone nor the water gas shift operation are depicted in FIG. 2.

The $C_3$-plus hydrocarbon product stream is conveniently sent by way of line 19 to fractionation equipment not shown to separate and remove gasoline boiling range material from both higher and lower boiling hydrocarbon component materials.

The water phase from separation zone 17, i.e., the water-containing condensation product, is sent via line 20 to treating zone 21, wherein the sulfur compounds and nitrogen compounds are separated from the water phase and removed therefrom by line 22. The treated water is withdrawn from treating zone 21 via line 23 and is sent to the riser reaction zone 4 via line 24, and/or the regeneration zone 1 via line 25, and/or the water gas shift operation mentioned above via line 26.

In yet another embodiment, excess CO removed from the regeneration zone 1 is purified and combined with hydrogen produced in the riser reaction zone 4 to form a synthesis gas stream that can be converted to methane, methanol, of Fischer-Tropsch products.

The spent sorbent material, having a coke level within the range of about 0.3 wt. % to about 3 wt. %, is then transferred from reactor disengaging vessel 10 to regeneration zone 1 by way of transfer line 12 and stripping zone 13. Spent sorbent is contacted with 1–20 lb. of steam per 1,000 lb. of sorbent in stripping zone 13.

The stripped spent sorbent material is then passed via line 12 into regeneration zone 1, where it is contacted with a mixture of oxygen and steam to obtain a relatively coke-free regenerated sorbent. The spent sorbent is transferred into the regeneration zone 1. An oxygen-containing gas, such as air, is introduced into the regeneration zone 1 by way of line 14, the amount of oxygen-containing gas, contains 20 vol. % oxygen. The steam is added to regeneration zone 1 by line 15. The ratio of steam to oxygen should be maintained within the range of about 0.1 to about 10. The carbonaceous material is removed from the sorbent material via oxidation, water gas, and gasification reactions. The flue gases formed during the regeneration are vented from the regeneration zone 1 by way of vent line 16. The temperature in the regeneration zone 6 is maintained within the range of about 732° C. (1350° F.) to about 927° C. (1700° F.). The hot regenerated sorbent material, having a coke level within the range of about 0.05 wt. % to about 0.50 wt. %, is then recycled to riser reaction zone 4 by way of regenerated sorbent standpipe 2 and riser wye 3. The cycle is then repeated.

It is to be understood that the regenration zone 1 can be any of several types that are well known in the art, e.g., a single-stage regenerator, a two-stage regenerator with external circulating lines, or a two-stage regenerator with internal circulating lines.

The metals remain on the sorbent material and accumulate as it is recycled through the system. Hence, the metals content could be within the range of about 5,000 ppm (by wt.) to about 70,000 ppm (by wt.). While the carbonaceous material is removed continuously, the metals content builds up to a level which necessitates that the sorbent be replaced by virgin sorbent.

Please note that the nickel on the regenerated sorbent is reduced in the lower portion of the riser reaction zone, where hydrogen can be added, if needed, to supplement that formed by the steam reforming reaction occurring in the riser. Of course, a separate reducing vessel, not shown, could be used.

The process of the present invention is an improved process for removing carbon formers and metals from carbo-metallic oils. The combination of reactions with steam in the regeneration zone and the steam reforming in the riser reaction zone provide a system for maximum removal of coke at higher temperatures not available in the prior art.

The process of the present invention also produces a synthesis gas, which with or without combining with hydrogen gas from the reactor, is purified, shifted to a preferred $H_2/CO$ ratio and converted into additional gasoline via a Fischer-Tropsch process, methanol or other absorbs, or methane depending on economic optimization and requirement for liquid transportation fuels.

Specific compositions, methods, or embodiments discussed are intended to be only illustrative of the invention disclosed by this Specification. Variation on these compositions, methods, or embodiments are readily apparent to a person of skill in the art based upon the teachings of this Specification and are therefore intended to be included as part of the inventions disclosed herein.

Reference to patents made in the Specification is intended to result in such patents being expressly incorporated herein by reference including any patents or other literature references cited within such patents.

What is claimed is:

1. A process for the decarbonization and demetallization of a heavy hydrocarbon stream containing substantial amounts of carbon formers and metals, said hydrocarbon stream being a member of the group consisting of residual oils, reduced crudes, topped crudes, and other high-boiling feeds containing substantial amounts of carbon formers, and mixtures thereof, which process comprises:

A. contacting said stream in a riser reaction zone with a relatively inert solid particulate sorbent in the presence of steam and under reaction conditions comprising a temperature within the range of about 482° C. (900° F.) to about 649° C. (1,200° F.), a pressure within the range of about 1 atm. (0 psig) to about 3.38 atm. (35 psig), a contact time within the range of about 1 sec. to about 2 sec., a steam-to-hydrocarbon weight ratio within the range of about 4 gm. of water per 100 gm. of hydrocarbons to about 20 gm. of water per 100 gm. of hydrocarbons, and a sorbent-to-hydrocarbon weight ratio within the range of about 3 gm. of sorbent per gm. of hydrocarbons to about 8 gm. of sorbent per gm. of hydrocarbons to form a coked particulate sorbent and gaseous hydrocarbons comprising hydrocarbons, hydrogen, and CO, said particulate sorbent being a calcined member of the group consisting of spent catalysts have low activities, bentonite, kaolin, attapulgus clay, montmorilonite, smectites, other two-layered lamellar silicates, mullite, pumice, silica, laterite, low-surface area silica gel, low-surface area bauxite, and combinations thereof, B. separating said gaseous hydrocarbons from said coked particulate sorbent, passing said coked particulate sorbent through a stripping zone to remove from said coked particulate sorbent loosely-held hydrocarbons and to provide a stripped, coked particulate sorbent, C. separating said gaseous hydrocarbons into a light gaseous hydrocarbon product stream comprising $C_2$-minus hydrocarbons, hydrogen, and CO, a $C_3$-plus hydrocarbon product stream, and a water-containing condensation product, recovering a hydrocarbon-containing gas stream separately from said light gaseous hydrocarbon product stream, and purifying said hydrogen-containing gas stream, and obtaining useful hydrocarbon products from said $C_3$-plus hydrocarbon product stream, D. contacting stripped, coked particulate sorbent in a regeneration zone with a mixture of steam and oxygen under suitable regeneration conditions comprising a temperature within the range of about 732° C. (1,350° F.) to about 927° C. (1,700° F.), a pressure within the range of about 1 atm. (0 psig) to about 3.38 atm. (35 psig), an oxygen-to-coke weight ratio within the range of about 1.1 gm. of oxygen per gm. of coke to about 2.8 gm. of oxygen per gm. of coke, and a steam-to-oxygen weight ratio within the range of about 0.2 gm. of water per gm. of oxygen to about 8 gm. of water per gm. of oxygen, to provide a regenerated particulate sorbent having reduced amounts of carbon and metals and a regeneration flue gas comprising CO and a small amount of hydrogen, E. passing said regenerated particulate sorbent to said riser reaction zone, F. combining said regeneration flue gas with said hydrogen-containing gas stream to produce a combined synthesis gas, G. treating at least a portion of said water-containing condensation product for removal of sulfur and nitrogen compounds to provide a treated water-containing condensation product and recycling said treated water-containing condensation product to said riser reaction zone, said regeneration zone, or said riser reaction zone and said regeneration zone, and H. regulating the balancing with each other the conditions that are employed in said riser reaction zone and the conditions that are employed in said regeneration zone to provide temperatures that fall within the temperatures ranges presented hereinabove, a carbon level on spent particulate sorbent within the range of about 0.8 wt. % to about 8 wt. %, based upon the weight of said spent particulate sorbent, and a carbon level on regenerated particulate sorbent within the range of about 0.5 wt. % to about 0.50 wt. %, based upon the weight of said regenerated particulate sorbent.

* * * * *